US006666196B2

(12) United States Patent
Skinner et al.

(10) Patent No.: US 6,666,196 B2
(45) Date of Patent: Dec. 23, 2003

(54) IGNITION SYSTEM HAVING IMPROVED SPARK-ON-MAKE BLOCKING DIODE IMPLEMENTATION

(75) Inventors: Albert Anthony Skinner, Anderson, IN (US); Douglas Lynn Sprunger, Middletown, IN (US)

(73) Assignee: Delphi Technologies, Inc., Troy, MI (US)

( * ) Notice: Subject to any disclaimer, the term of this patent is extended or adjusted under 35 U.S.C. 154(b) by 42 days.

(21) Appl. No.: 10/043,467

(22) Filed: Jan. 10, 2002

(65) Prior Publication Data

US 2003/0127081 A1 Jul. 10, 2003

(51) Int. Cl.[7] ..... F02P 3/00
(52) U.S. Cl. ..... 123/655; 123/645
(58) Field of Search ..... 123/645, 655

(56) References Cited

U.S. PATENT DOCUMENTS

| | | | | |
|---|---|---|---|---|
| 4,463,744 A | * | 8/1984 | Tanaka et al. | 123/655 |
| 5,586,542 A | | 12/1996 | Taruya et al. | 123/609 |
| 5,675,072 A | | 10/1997 | Yasuda et al. | 73/35.08 |
| 6,082,344 A | * | 7/2000 | Ito et al. | 123/645 |
| 6,116,226 A | * | 9/2000 | Vogel | 123/655 |
| 6,186,130 B1 | | 2/2001 | Skinner et al. | 123/625 |
| 6,247,465 B1 | | 6/2001 | Sprunger | 123/609 |
| 6,539,930 B2 | * | 4/2003 | Inagaki | 123/655 |

* cited by examiner

*Primary Examiner*—Erick Solis
(74) *Attorney, Agent, or Firm*—Jimmy L. Funke

(57) ABSTRACT

An ignition coil assembly includes a high voltage (HV) diode at both ends of the secondary winding. The diodes prevent a spark-on-make condition. The diode implementation has particular benefits when used in a 42 volt automotive electrical system.

11 Claims, 1 Drawing Sheet

IGNITION SYSTEM HAVING IMPROVED SPARK-ON-MAKE BLOCKING DIODE IMPLEMENTATION

BACKGROUND OF THE INVENTION

1. Technical Field

The present invention relates to an ignition system having an improved high voltage diode implementation for preventing a spark-on-make condition in an internal combustion engine.

2. Description of the Related Art

A conventional automotive ignition system includes a spark plug for each combustion chamber of an engine, at least one ignition coil and at least one device adapted to selectively charge the coil(s) and cause the energy stored in the coil(s) to be discharged through the spark plugs in a timed manner. As a result, a spark is generated and ignition of a fuel-air mixture in each combustion chamber occurs at a specified timing.

When charging of the coil is initiated, however, a transient voltage is created across the secondary winding of the ignition coil, which is connected to the spark plug. In some situations, this transient voltage may be high enough to create a spark at the spark plug. This kind of sparking event is commonly referred to as a spark-on-make event or condition because historically it would occur when the breaker points of the ignition system made contact to commence charging of the ignition coil. The term "spark-on-make", as used in this disclosure, however, is not limited to situations where conventional breaker points are used. To the contrary, it refers to any situation where initiation of coil or ignition system charging causes a spark at one or more of the spark plugs. This kind of sparking event, however, is undesirable because it is not timed for proper engine operation. It can cause severe damage to engine components.

Recent advances in technology have made it more practical and desirable in some situations to provide a coil-per-cylinder ignition arrangement (i.e., wherein a coil is provided for each cylinder of the engine). While the coil-per-cylinder arrangements provide some benefits and advantages, the spark-on-make condition is more likely to occur in such an arrangement. The spark-on-make conditions or events, as a result, tend to detract from the benefits achieved by providing a coil for each cylinder.

One approach taken in the art to suppress and/or avoid a spark-on-make condition involves providing a high voltage (HV) diode that is used to permit the flow of current in one direction to the spark plug (i.e., to allow flow of the spark current) but not in the reverse direction. This configuration allows the coil to be discharged after sufficient and at the proper time, while preventing application of the transient voltage created during initiation of the charging process. For example, U.S. Pat. No. 5,586,542 issued to Taruya et al. disclose an ignition coil composed of a primary coil and a secondary coil wherein a high-tension diode for preventing faulty operation is inserted to the output terminal of the secondary coil. However, in terms of a conventional 14 volt automotive system, a typical "make" voltage ranges between about 1500 to 2000 volts. The conventional approach of using a high voltage diode is effective with the use of a single, conventional 3 kV diode. It is known to place such diodes on either the high voltage end (such as disclosed in Taruya et al.) or the low voltage end of the ignition coil secondary. The foregoing approach, however, has limitations.

In particular, a 42 volt standard has been proposed for both Europe and the United States for automotive vehicle electrical systems. In such a 42 volt system, the "make" voltages will be approximately three times higher than that of a 14 volt system. While it may be possible to simply increase the voltage rating of the above-mentioned 3 kV diode to 6 kV, the 6 kV diode has an increased length compared to a 3 kV diode, and would therefore increase difficulties in packaging, particularly if such a 6 kV diode were placed at the high voltage end of the secondary winding, as would simply including two 3 kV diodes in series.

There is therefore a need to provide an improved ignition system that minimizes or eliminates a spark-on-make condition, as well as minimizing or eliminating one or more of the shortcomings as set forth above.

SUMMARY OF THE INVENTION

One object of the present invention is to provide a solution to one or more of the above-identified problems. The invention involves packaging one HV diode at both ends of a secondary winding of an ignition coil assembly. One advantage of the present invention is that it allows for suppression of a spark-on-make condition, particularly for increased voltage systems, such as a 42 volt automotive electrical system, without increasing the number of components, the number of connections, or the number of assembly operations and the manufacture of an ignition apparatus, all as described in detail herein.

An ignition coil assembly is provided in accordance with the present invention, and includes a transformer having a core, a primary winding, and a secondary winding, as well as first and second diodes. The secondary winding has a high voltage end and a low voltage end. The first diode is disposed between the low voltage end and a low voltage node. In a preferred embodiment, the low voltage node comprises either a supply node (e.g., an automotive system supply) or a ground node. The second diode is disposed between the high voltage end and a connector associated with the ignition coil assembly configured for electrical connection to a spark plug.

A method of making an ignition coil assembly is also presented.

BRIEF DESCRIPTION OF THE DRAWINGS

The present invention will now be described by way of example, with reference to the accompanying drawings, in which.

DETAILED DESCRIPTION OF THE PREFERRED EMBODIMENTS

Figure 1:
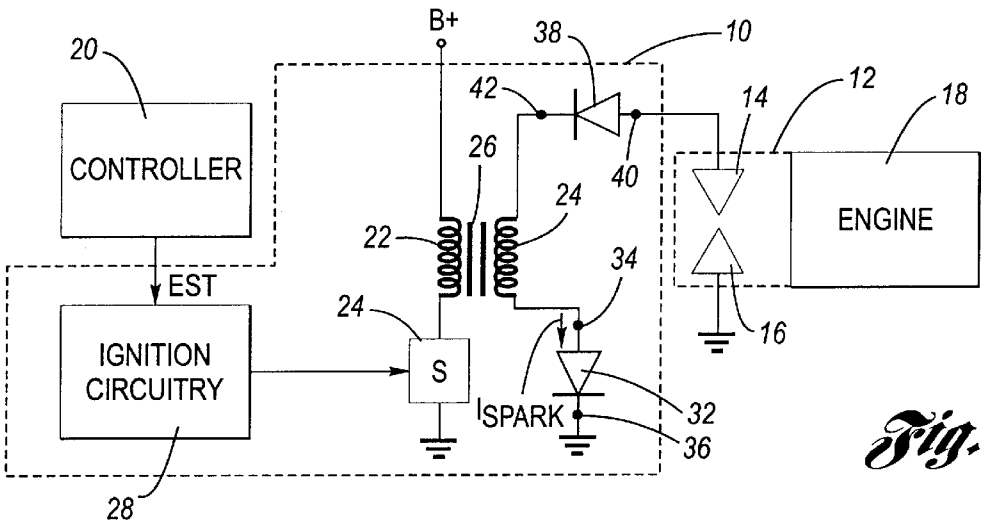
FIG. 1 is a simplified schematic and block diagram of an ignition coil assembly according to the present invention having a high voltage diode at both ends of a secondary winding.

Referring now to the drawings wherein like reference numerals are used to identify identical components in the various views, FIG. 1 is a simplified schematic and block diagram view of an ignition coil assembly 10 in accordance with the present invention. Ignition coil assembly 10 includes a pair of individual high voltage diodes connected to the high voltage end and the low voltage end of the secondary winding. Before proceeding to a detailed explanation of the improvement, a general description of the ignition system will be described.

The ignition coil assembly 10 is adapted for installation to a conventional spark plug 12 having space electrodes 14 and 16 received in the spark plug opening of an internal combustion engine 18. As known, the electrodes of spark plug 12 are located approximate the combustion cylinder of engine 18.

Ignition coil assembly 10 further includes a primary winding 22, a secondary winding 24 and a core 26 together defining a high voltage transformer. The ignition coil assembly 10 further includes ignition circuitry 28, a primary switch 30, a first high voltage diode 32 having a respective anode and cathode coupled to electrical nodes 34 and 36, and a second high voltage diode 38 having respective anode and cathode terminals coupled to electrical nodes 40 and 42.

With continued reference to FIG. 1, generally, overall spark timing (dwell control) is provided by a controller such as an engine control unit (ECU) 20 or the like. Controller 20, in addition to spark control, may also control fuel delivery, air control, and the like. In a global sense, control 20 is configured to control overall combustion in engine 18. Controller 20 may include, for example, a central processing unit (CPU) memory, and input/output, all operating according to preprogrammed strategies.

A high side end of primary winding 22 may be connected to a supply voltage provided by a power supply, such as a vehicle battery (not shown) hereinafter designated "B+" in the drawings. Supply voltage may, in one embodiment, nominally be approximately 42 volts. A second end of the primary winding 22 opposite the high side end is connected to switch 30.

Ignition circuitry 28 is configured to selectively connect, by way of switch 30, primary winding 22 to ground, based on an electronic spark timing (EST) signal, for example, provided by controller 20. Such a connection, as is generally known in the art, will cause a primary current Ip to flow through primary winding 22. Switch 30 may comprise conventional components, for example, a bipolar transistor, a MOSFET transistor, or an insulated bipolar transistor (IGBT). Ignition circuitry 28 may be configured to provide additional functions, for example, applying repetitive sparks to the combustion chamber during a single combustion event.

The EST signal referred to above is generated by controller 20 in accordance with known strategies based on a plurality of engine operating parameters, as well as other inputs. Dwell control generally involves the control of the timing of the initiation of the spark event (i.e., at a crank shaft position in degrees relative to a top dead center position of a piston in the cylinder) as well as a duration period. The asserted ignition control signal EST is the command to commence charging of the ignition coil assembly for a spark event. After charging, primary winding 22 is disconnected from ground, thereby interrupting the primary current Ip. It is well understood by those of ordinary skill in the art of ignition control that such an interruption will result in a relatively high voltage being immediately established across the secondary winding, due to the collapsing magnetic fields associated with the interruption of the primary current. The secondary voltage will continue to rise until reaching a breakdown voltage across electrodes 16, 14 of spark plug 12. Current will thereafter discharge across the gap (i.e., a spark current), as is generally understood in the art. The spark event, as is generally understood by those of ordinary skill in the art, is provided to ignite an air on fuel mixture introduced into the cylinder. During the spark event, a spark current, designated $I_{SPARK}$, flows across spaced electrodes 16, 14.

As described in the Background, a problem in the art involves a so-called "make" voltage that is produced across the secondary winding 24 when the ignition control signal is asserted (i.e., when charging of the ignition coil assembly 10 begins). The "make" voltage absent the improvements of the present invention, would tend to produce a spark across spaced electrodes 14, 16, wherein a spark-on-make current would flow, in a direction generally opposite to that of the spark current $I_{SPARK}$.

As shown in FIG. 1, however, first and second high-voltage diodes 32 and 38 are arranged so as to block flow of a spark-on-make current in a direction opposite that of a conventional spark current. The arrangement shown in FIG. 1, namely that of packaging one diode at each end of the secondary winding 24, exhibits several advantages. One advantage is that it does not increase the number of components. Another advantage is that it does not increase the number of connections. Finally, the arrangement does not increase the number of assembly operations. By way of explanation of these advantages, in a conventional ignition coil assembly, a high voltage terminal, generally formed of metal, is provided and includes a post or other projection onto which the high voltage end of the secondary winding can be terminated. Such as high voltage terminal would then provide a bridge to a high voltage connector for connection to a spark plug. As can be seen in FIG. 1, including diode 38 on the high voltage end simply replaces this existing terminal. Accordingly, the high voltage end of the secondary winding 24 may be terminated at node 42 to the cathode of diode 38. Likewise, the node 40 can provide an electrical coupling of the anode of diode 38 to a conventional electrical connector for connection to a spark plug. Moreover, if diode 32 is already included for spark-on-make prevention a 14 volt system style ignition coil assembly, then no additional components (i.e., the diode 38 just replaces the preexisting HV terminal), connections (same number as with a diode and an HV terminal), or assembly operations (i.e., same steps of connecting a diode would be involved in connecting an HV terminal) are needed. It should be understood, of course, that the converse is also true to the extent that the preexisting 14 volt system style ignition coil uses a high voltage diode connected to the high voltage end of the secondary winding with a terminal at the LV end. In such case, a terminal or the like on the low voltage end would be required in order to allow termination of the low voltage end of the secondary winding, and for connection to a low voltage node. As shown, the low voltage node to which the cathode of diode 32 is connected is illustrated as a ground node. However, as understood as known generally in the art, the low voltage end of the secondary winding may also be connected to a supply node (e.g., in the preferred embodiment, a 42 volt supply rail) since, as compared to the spark voltage generated either the ground node or 42 volts is a "low" voltage.

In the illustrated embodiment for a 42 volt system, each of the diodes 32, 38 may comprise a 3 kV high voltage diode. The configuration shown in FIG. 1 is superior to a single 6 kV diode since a 6 kV diode, as described in the Background, is longer and introduces packaging difficulties. In addition, a 6 kV diode is more expensive than two 3 kV diodes. In addition, arranging one high voltage diode at each end of the secondary winding is superior to having two diodes in series, inasmuch as including two diodes in series increases the number of components (i.e., since one of the series-connected diodes does not end up replacing an existing terminal), increases the number of connections and further increases the number of assembly operations.

Figure 2:
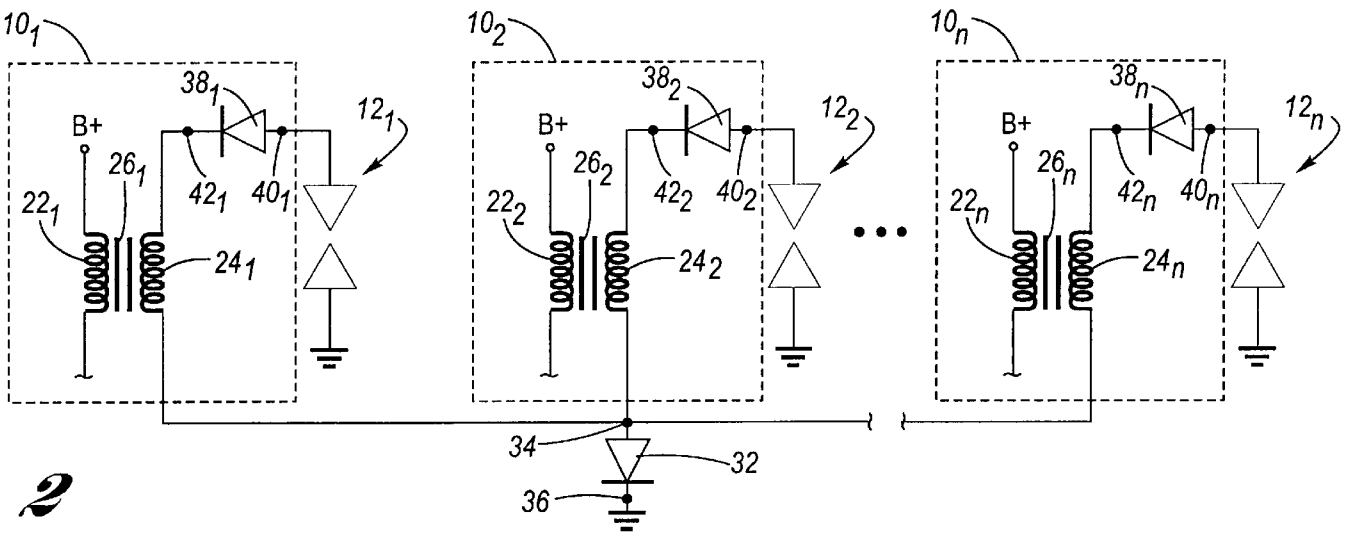
FIG. 2 shows an alternative embodiment of the present invention wherein the ignition coil assembly comprises a plurality of individual transformers with a high voltage diode at the high voltage end of each secondary winding and one high voltage diode connected to all the low voltage ends.

FIG. 2 shows a second, preferred embodiment where the teachings of the present invention lend benefits as used in a multi-coil ignition coil assembly (cassette arrangement). FIG. 2 shows multiple ignition coils, designated $\mathbf{10}_1$, $\mathbf{10}_2$, . . . $\mathbf{10}_N$, each comprising a respective primary winding, secondary winding, core and high voltage diode. In FIG. 2, the identical reference numeral is used as in FIG. 1, but has been modified by a subscript corresponding to the transformer number. FIG. 2 further shows that the low voltage ends of the secondary windings are tied (i.e., electrically connected) to the anode of diode 32 at electrical node 34, which is then connected to ground at the diode's cathode via connection 36.

What is claimed is:

1. An ignition coil assembly comprising:

a transformer having a core, a primary winding, and a secondary winding with a high voltage end, and a low voltage end;

a first diode disposed between the low voltage end and a low voltage node; and a second diode disposed between the high voltage end and a connector configured for electrical connection to a spark plug, wherein said first diode has a first cathode and a first anode and the second diode has a second cathode and a second anode, wherein said first anode of said first diode is coupled to said low voltage end of said secondary winding and said second cathode of said second diode is coupled to said high voltage end of said secondary winding, wherein said transformer is a first transformer, said ignition coil assembly further comprising a second transformer having another secondary winding with a respective high voltage end coupled to a third diode and a respective low voltage end coupled to said first anode of said first diode.

2. The assembly of claim 1 wherein said third diode includes a third cathode and a third anode, said third cathode being coupled to said high voltage end of said secondary winding of said second transformer.

3. An ignition coil assembly comprising:

a transformer having a core, a primary winding, and a secondary winding with a high voltage end, and a low voltage end;

a first diode disposed between the low voltage end and a low voltage node; and a second diode disposed between the high voltage end and a connector configured for electrical connection to a spark plug, wherein said primary winding has a first end coupled to a supply node and a second end coupled to a switch, said switch being coupled to a ground node, said switch being responsive to an ignition control signal for conducting a primary current through said primary winding, wherein said supply node comprises a vehicle power source having a nominal voltage between about 12 and 14 volts, said first and second diodes having a reverse breakdown characteristic of at least about 1.5 kV.

4. An ignition coil assembly comprising:

a transformer having a core, a primary winding, and a secondary winding with a high voltage end, and a low voltage end;

a first diode disposed between the low voltage end and a low voltage node; and a second diode disposed between the high voltage end and a connector configured for electrical connection to a spark plug, wherein said primary winding has a first end coupled to a supply node and a second end coupled to a switch, said switch being coupled to a ground node, said switch being responsive to an ignition control signal for conducting a primary current through said primary winding, wherein said supply node comprises a vehicle power source having a nominal voltage of about 42 volts, said first and second diodes having a reverse breakdown characteristic of at least about 3 kV.

5. An ignition coil assembly comprising:

transformer means for generating a spark voltage on a high voltage end of a secondary winding portion thereof responsive to an input voltage applied to a primary winding portion of the transformer means, said secondary winding having a low voltage end;

first diode means between said low voltage end and a low voltage node for suppressing flow of a spark-on-make current; and second diode means between said high voltage end and a spark plug connector for suppressing flow of said spark-on-make current.

6. The assembly of claim 5 wherein said first diode means has a first cathode and first anode and the second diode means has a second cathode and a second anode, wherein said first anode of said first diode means is coupled to said low voltage end of said secondary winding and said second cathode of said second diode means is coupled to said high voltage end of said secondary winding.

7. The assembly of claim 6 wherein said transformer means is a first transformer means, said ignition coil assembly further comprising a second transformer means having another secondary winding with a respective high voltage end coupled to a third diode means for blocking said spark-on-make current and a respective low voltage end coupled said first anode of said first diode means.

8. The assembly of claim 7 wherein said third diode means includes a third cathode and a third anode, said third cathode being coupled to said high voltage end of said secondary winding of said second transformer means.

9. The assembly of claim 5 wherein said primary winding has a first end coupled to a supply node and a second end coupled to a switch, said switch being coupled to a ground node, said switch being responsive to an ignition control signal for conducting a primary current through said primary winding.

10. The assembly of claim 8 wherein said supply node comprises a vehicle power source having a nominal voltage of about 14 volts, said first and second diode means having a reverse breakdown characteristic of at least about 1.5 kV.

11. The assembly of claim 8 wherein said supply node comprises a vehicle power source having a nominal voltage of about 42 volts, said first and second diode means having a reverse breakdown characteristic of at least about 3 kV.

* * * * *